US009406463B2

(12) United States Patent
Braaten

(10) Patent No.: US 9,406,463 B2
(45) Date of Patent: Aug. 2, 2016

(54) ERGONOMIC FOOT SWITCH

(71) Applicant: CONNTROL INTERNATIONAL, INC, Putnam, CT (US)

(72) Inventor: Ronald Braaten, Woodstock, CT (US)

(73) Assignee: CONNTROL INTERNATIONAL, INC, Putnam, CT (US)

( * ) Notice: Subject to any disclaimer, the term of this patent is extended or adjusted under 35 U.S.C. 154(b) by 0 days.

(21) Appl. No.: 14/529,488

(22) Filed: Oct. 31, 2014

(65) Prior Publication Data

US 2015/0114808 A1 Apr. 30, 2015

Related U.S. Application Data

(60) Provisional application No. 61/898,112, filed on Oct. 31, 2013.

(51) Int. Cl.
*H01H 3/14* (2006.01)
*H01H 21/26* (2006.01)

(52) U.S. Cl.
CPC ..... *H01H 21/26* (2013.01); *H01H 2221/044* (2013.01)

(58) Field of Classification Search
CPC ..... A61C 1/0015; G06F 3/0334; H01H 21/26
USPC ..... 200/86.5, 339; 74/478, 512
See application file for complete search history.

(56) References Cited

U.S. PATENT DOCUMENTS 3,983,344 A * 9/1976 Straihammer ..... A61C 1/0023 200/86.5
4,117,280 A * 9/1978 Feaster ..... H01H 23/006 200/339
5,712,460 A * 1/1998 Carr ..... A61B 17/32002 200/86.5
6,956,179 B2 * 10/2005 Gillman ..... H01H 23/065 200/302.3
2008/0129695 A1 * 6/2008 Li ..... G06F 3/03543 345/163

* cited by examiner

*Primary Examiner* — Vanessa Girardi
(74) *Attorney, Agent, or Firm* — Cantor Colburn LLP

(57) ABSTRACT

A switch is provided including an actuating body and a base where the actuating body is movably disposed upon the base, the actuating body has an arcuate shape delimited by generally parallel arc edges joined at their ends by curved edges, the actuating body includes an upper surface which inclines in a direction from a concave side of the arcuate shaped actuating body to a convex side thereof, and the actuating body is configured to pivot in a direction toward at least one of the end curved edges.

14 Claims, 7 Drawing Sheets

ERGONOMIC FOOT SWITCH

CROSS REFERENCE TO RELATED APPLICATION

This U.S. non-provisional patent application is related to and claims the benefit of U.S. provisional application Ser. No. 61/898,112 filed on 31 Oct. 2013, the contents of which are herein incorporated by reference in their entirety.

TECHNICAL FIELD

This invention relates to switches for electrically controlling mechanical movement of a physical object. More particularly, the invention relates to an improved ergonomic foot switch assembly.

BACKGROUND

Foot switches are used in many applications: industrial, commercial, medical, residential, etc. Industrial applications may include operation of power tools, conveyers, lifting devices, and many other applications. Often, plural foot operated switches are utilized to control more than one operation or function. One common example is the up and down motion of a lifting or vertical positioning device.

A typical switch arrangement for such a multi-operation device essentially consists of two separate foot switches which are toggled by two separate actuators. In operating such a dual switch, the user must remove their foot from one actuator and strike the other actuator. This allows for the possibility of the user partially striking the actuator, or missing the actuator entirely. This creates error, confusion, and fatigue. Moreover, these traditional dual switches are typically rectangular or block shape and include no ergonomic features for providing comfort and reducing fatigue to the user. Furthermore, due to their generic block shape, these traditional dual switches provide no haptic or tactile feedback to the user regarding the location of the actuators or the correct positioning of the user's foot with respect to the switch device. As a result, the user must constant visually assess the position of their foot upon and proximate to the switch, thus causing operational delays and lending to the fatigue of the user.

BRIEF SUMMARY OF THE INVENTION

The above and other drawbacks and deficiencies are overcome or alleviated by a switch including an actuating body and a base where the actuating body is movably disposed upon the base, the actuating body has an arcuate shape delimited by generally parallel arc edges joined at their ends by curved edges, the actuating body includes an upper surface which inclines in a direction from a concave side of the arcuate shaped actuating body to a convex side thereof, and the actuating body is configured to pivot in a direction toward at least one of the end curved edges.

The above discussed and other features and advantages of the present invention will be appreciated and understood by those skilled in the art from the following description and drawings.

BRIEF DESCRIPTION OF THE DRAWINGS

Referring to the exemplary drawings wherein like elements are numbered alike in the several FIGS..

DETAILED DESCRIPTION OF THE PREFERRED EMBODIMENTS

Figure 1:
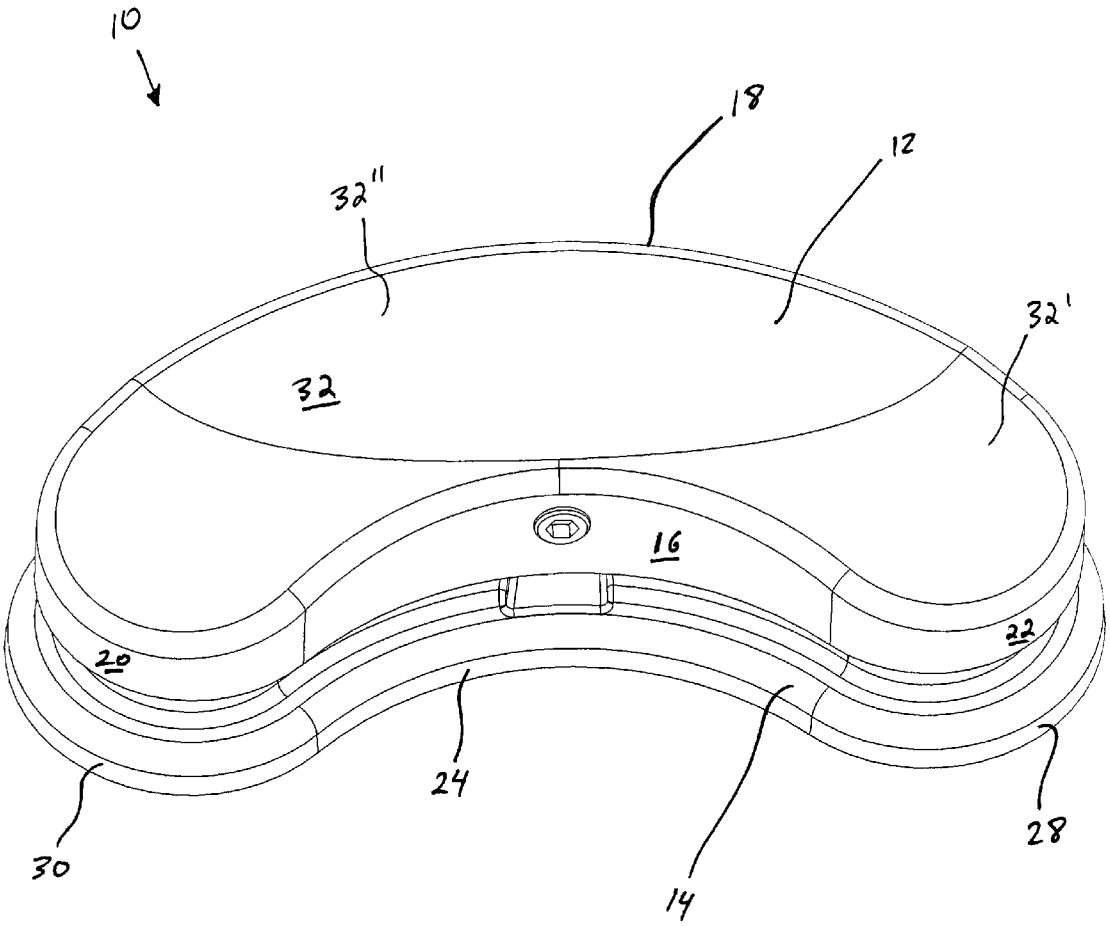
FIG. 1 is a perspective view of an exemplary embodiment of switch.
Figure 2:
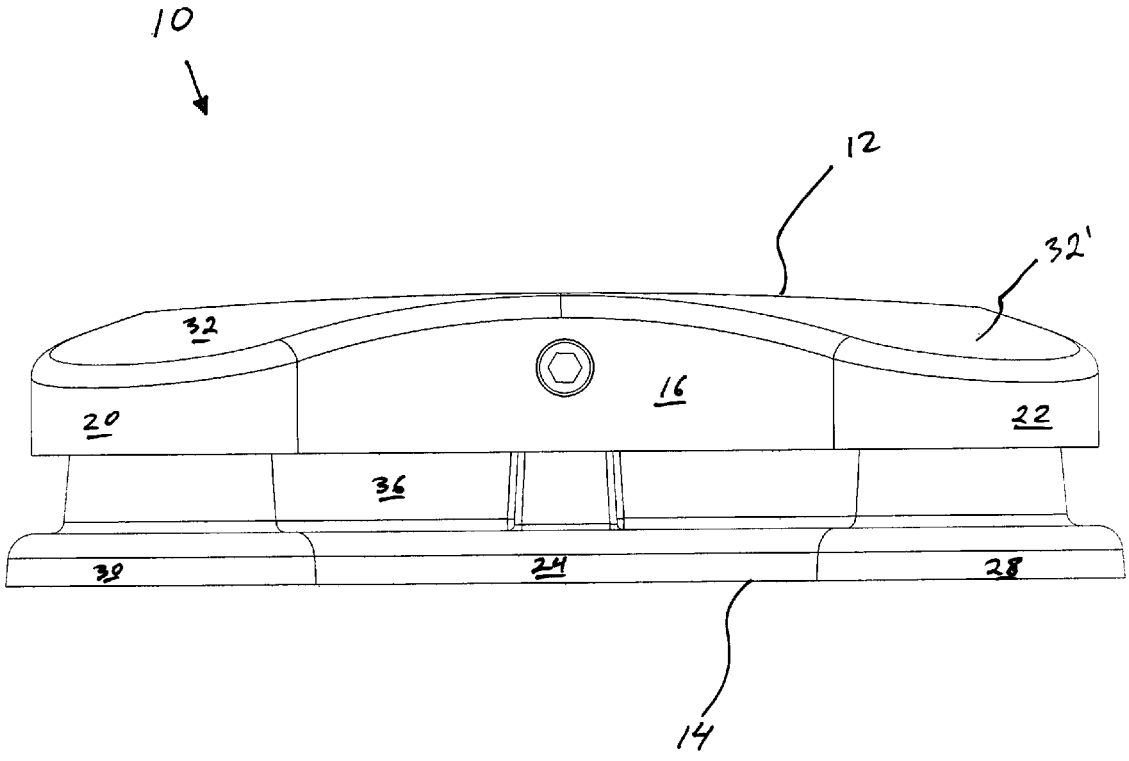
FIG. 2 is a front elevation view thereof.
Figure 3:
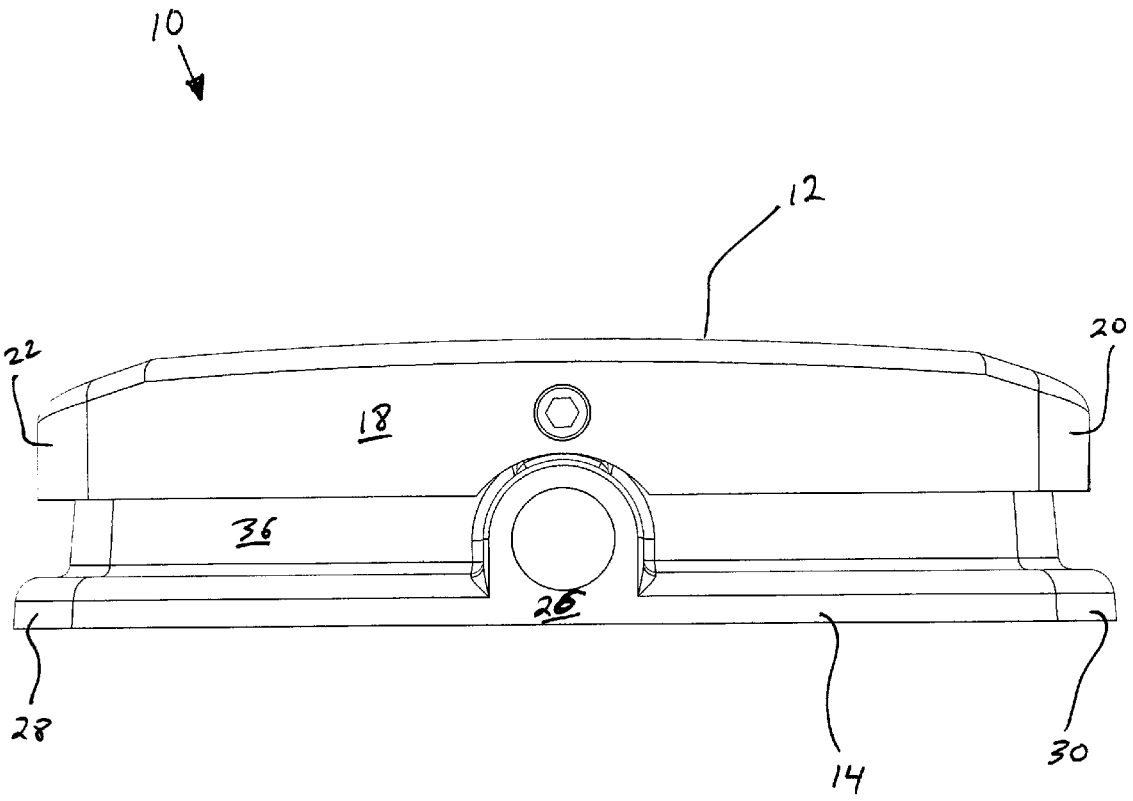
FIG. 3 is a rear elevation view thereof.
Figure 5:
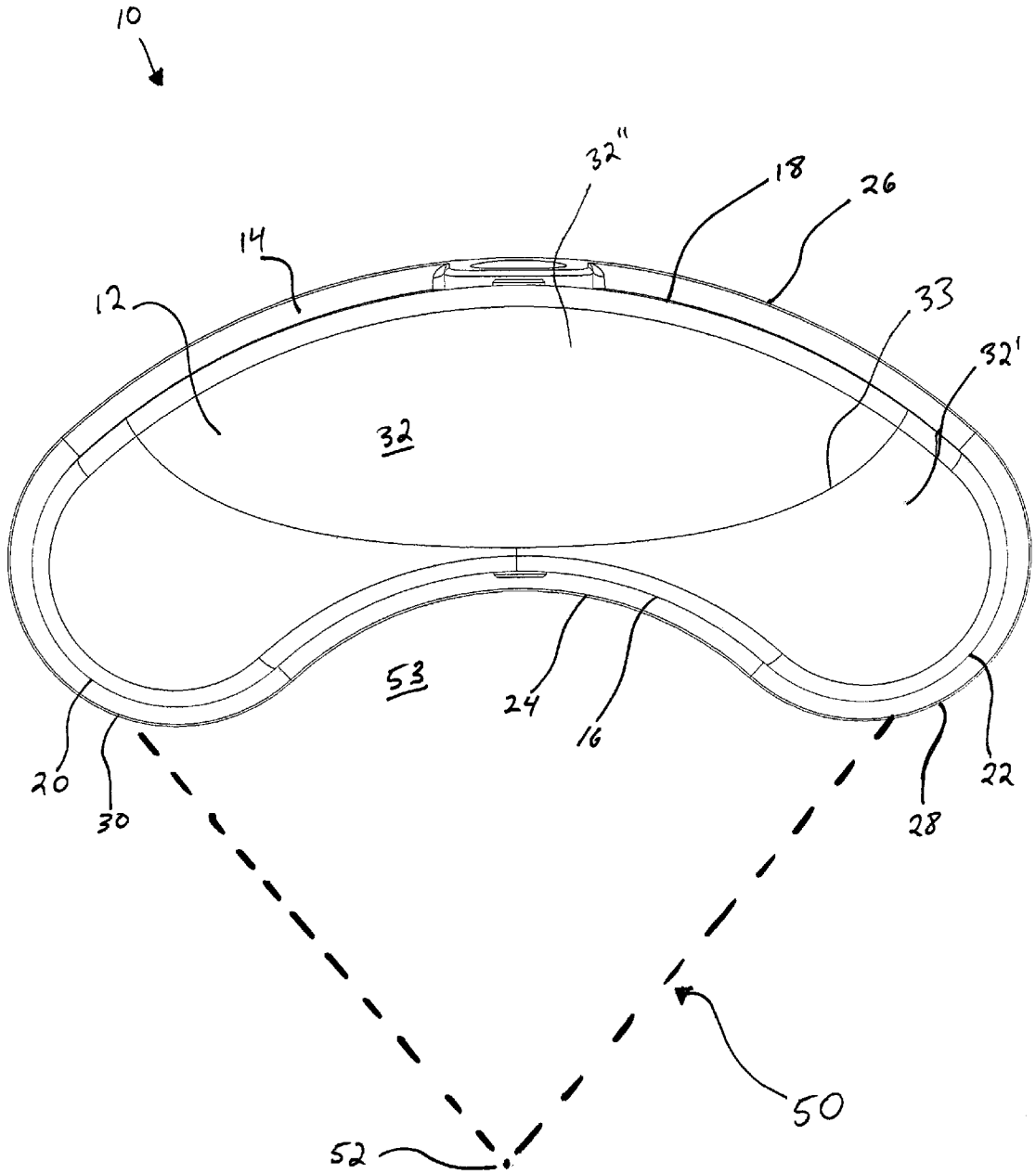
FIG. 5 is a top plan view thereof.

FIG. 1 is a perspective view of a switch 10 including an actuating body 12 disposed upon a base 14. Both the actuating body 12 and the base 14 have an arcuate shape which is particularly evident in FIG. 1 and also in FIG. 5 which shows a top plan view of the switch 10. The actuating body 12 is formed of an inner arc edge 16 and a corresponding outer arc edge 18. The arcs which form edges 16 and 18 are parallel, i.e., they are diametric portions of concentric circles. The edges 16 and 18 are joined at one end by a first curved end edge 20 and at the opposite end by a second curved end edge 22. The base 14 similarly includes inner and outer arc edges 24 and 26 which are joined by first and second curved end edges 28 and 30. In the illustrated embodiment, the arcs and curves forming the edges 24, 26, 28, and 30 of the base 14 correspond to and are of equivalent curvature as the arcs and curves 16, 18, 20, and 22 which delimit the perimeter of the actuating body 12. That is, the arc edges 16, 18, 24, and 26 are parallel as are the curved end edges 20 and 30 and the curved end edges 22 and 28. The outer arc edges 18 and 26 form a convex side of the switch 10 while the inner arc edges 16 and 24 form a concave side of the switch 10. Of course, this configuration is merely exemplary; the curvature of the various edges 16, 18, 20, 22, 24, 26, 28, 30 may vary within the respective body 12 or base 14 and/or may vary between the body 12 and base 14.

The outer perimeter of the base delimited by the inner and outer arc edges 24 and 26 and the first and second curved end edges 28 and 30 may be greater than, less than, or equal to the perimeter of the actuating body 12 delimited by the edges 16, 18, 20, and 22, depending upon a particular application. In the illustrated embodiment, the base 14 of the switch is slightly larger than the actuating body 12.

Figure 4A:
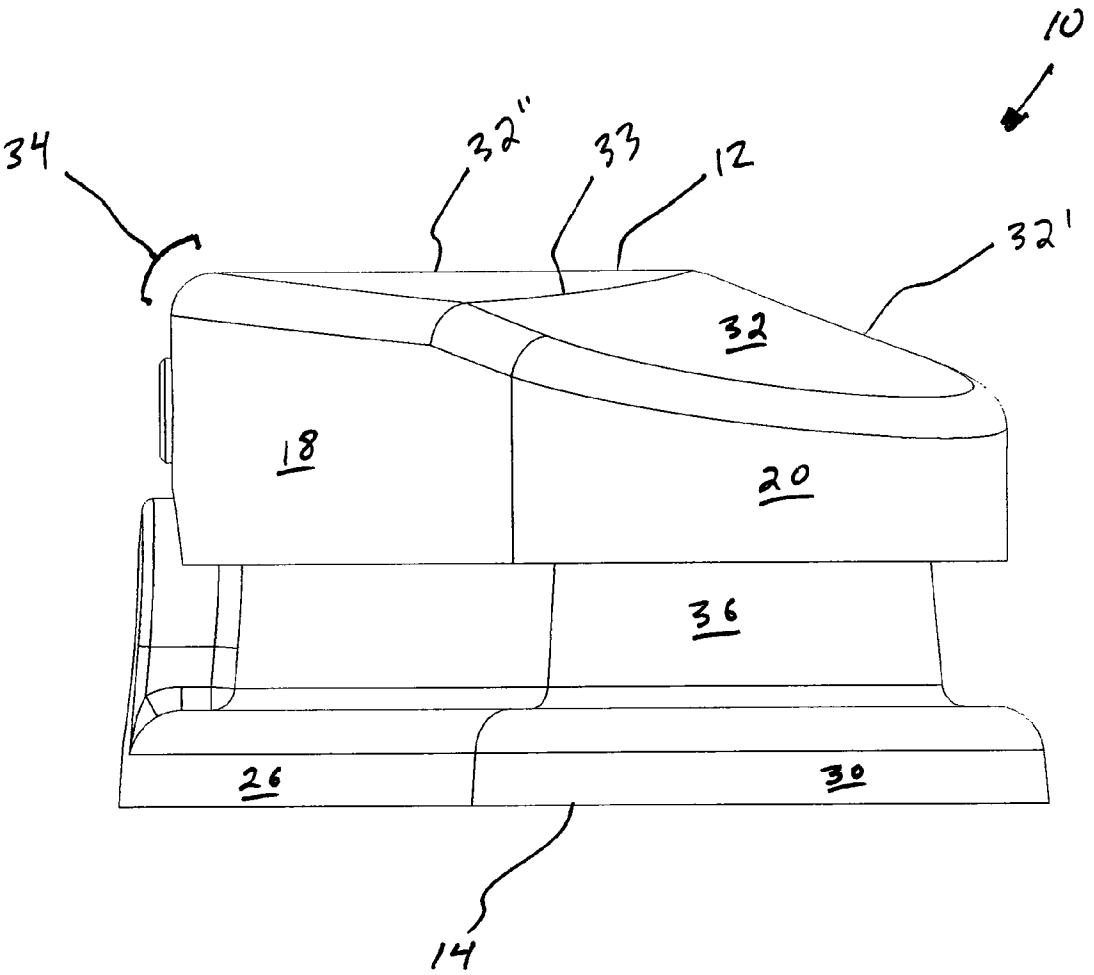
FIGS. 4A-B are end elevation views thereof.
Figure 4B:
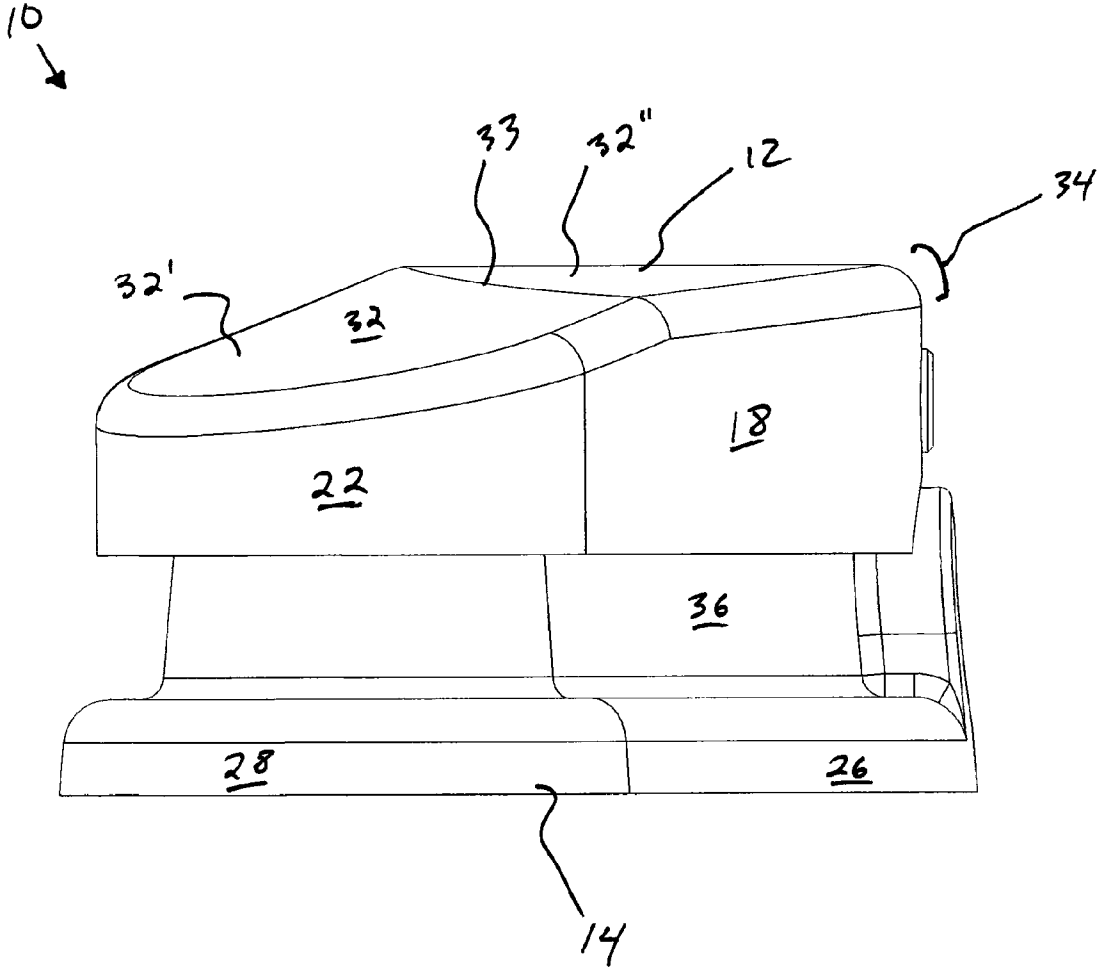

The arc and end edges 16, 18, 20, and 22 of the actuating body 12 form an upper surface 32 of the switch 10. This upper surface 32 is inclined in a direction from the inner arc edge 16 toward the outer arc edge 18. See FIGS. 4A-B. The upper surface 32 can extend in an inclined fashion in its entirety from the inner arc edge 16 to the outer arc edge 18. Alternatively, the surface 32 can include an inclined portion and a horizontal portion and/or a declined portion. Also, the inclination of the upper surface 32 can vary in pitch such that it is steeper in certain and less steep in others. Additionally, the inclination may extend continuously or intermittently across the width of the switch 10 between the first end edge 20 and the second end edge 22. The inclination of the upper surface 32 can have a linear or a curvilinear profile. In the illustrated example, the upper surface 32 includes a first inclined portion 32' and a second generally horizontal portion 32". The inclined portion 32' extends from the edges 16, 20, 22 and angles upwardly toward the second portion 32". The first inclined portion 32' meets the second horizontal portion 32" along a curved edge 33 which traverses the upper surface in a generally concave manner when the switch 10 is viewed from above, as in FIG. 5. The curved edge 33 defines where the inclined portion 32' of the upper surface 32 transitions into the generally horizontal portion 32". Here, the horizontal surface 32' may be consistently horizontal across its width and length or, alternatively, the surface 32' may include a generally horizontal region and also include one or more curved regions which curve downwardly and/or upwardly from the horizontal region.

The various edges 16, 18, 20, and 22 of the upper surface 32 of the actuating body 12 each have a curved profile 34 which extends from a vertical extent of the edges 16, 18, 20, 22 to the upper surface 32. This curved profile 34 can be consistent around the perimeter of the upper surface 32, or may vary. For example, the radius of curvature of the profile 34 may be greater along the inner arc edge 16 than that along the outer arc edge 18.

Figure 6:
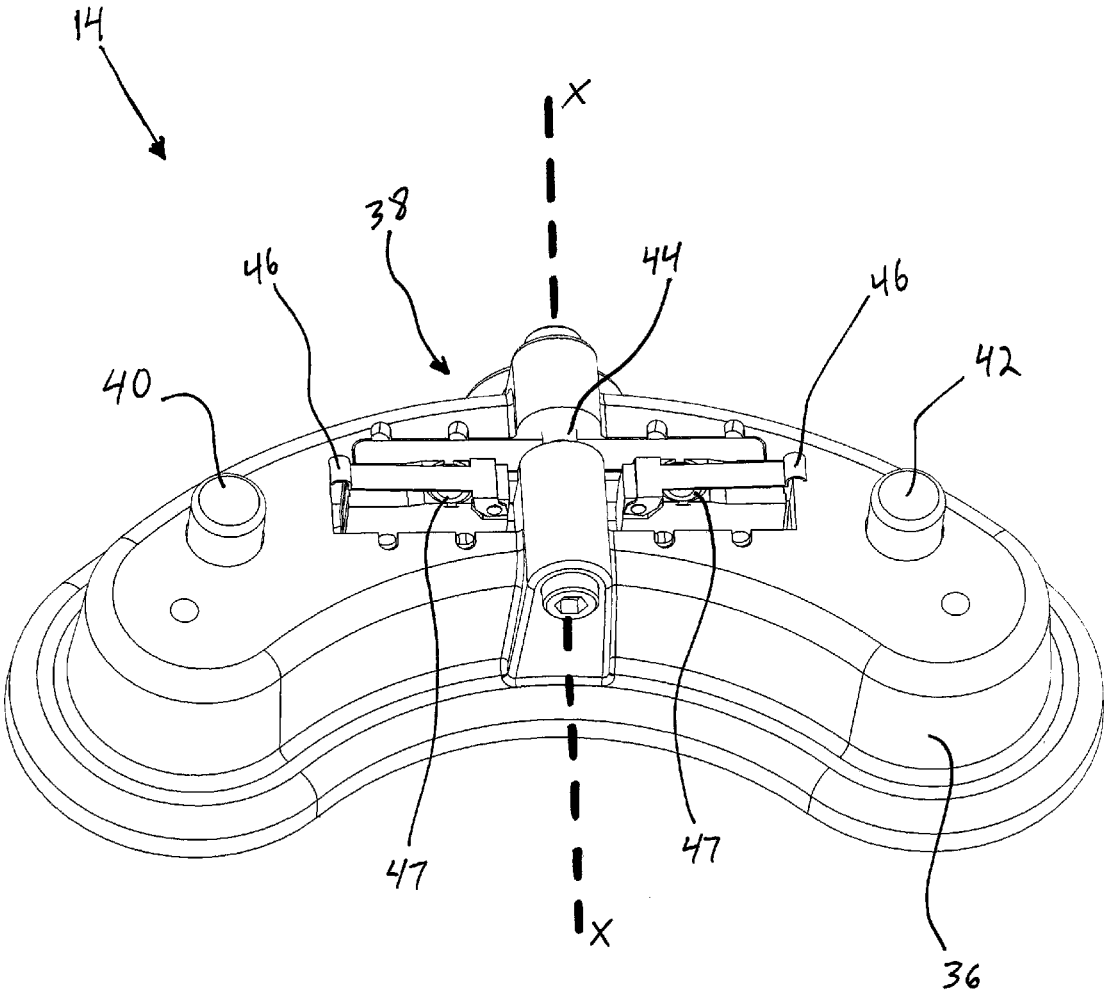
FIG. 6 is a perspective view thereof with portions of the actuating body being shown in transparent fashion.

The actuating body 12 is disposed upon the base 14 in such a manner that the body 12 can be actuated in order to toggle, i.e., activate or deactivate, a switch mechanism. One exemplary embodiment of this configuration is shown in FIG. 6 which illustrates the switch 10 with the actuating body 12 omitted so that the underlying elements are visible. As seen in this drawing, the base 12 includes a raised portion 36 which includes a pivot assembly 38, a first closed end eyelet 40, and a second closed end eyelet 42. The pivot assembly 38 includes a pivot rod 44 and lever actuators 46 arranged on either side of the rod 44. The eyelets 40, 42 are disposed at opposite ends of the raised portion 36. A pin plunger 47 is disposed beneath each of the lever actuators 46 such that the actuators 46 contact the respective plungers 47 when the actuators 46 are moved in a downward direction. In the illustrated embodiment, the lever actuators 46 are attached at one end to the raised portion 36 of the base 14. An opposite end of the lever actuators 46 extends upwardly to engage the actuating body 12. As discussed further below, the lever actuators 46 are configured to pivot about their fixed ends so that they may be pivoted downward in order to contact and depress the respective pin plungers 47. Appropriate electronics and controls are contained within the raised base portion 36 which are configured to detect movement of the pin plungers 47 and to send appropriate signals based thereupon. For example, the electronics and controls may be configured to send activation and deactivation signals to a first piece of equipment disposed in communication with the switch 10 when a first pin plunger 47 is depressed and extended, respectively. Movement of the second pin plunger 47 may similarly activate and deactivate a second piece of equipment. Alternatively, the electronics and control within the raised portion 36 may be configured such that both pin plungers 47 control a single piece of equipment. For example, movement of the first pin plunger 47 may signal a piece of equipment to perform a first operation and movement of the second pin plunger 47 may signal a second operation. In another alternative, each of the pin plungers 47 may control multiple pieces of equipment. The plungers 47 may depress in one movement or they may progress through several stages prior to complete depressions. Signals can be sent at each stage of depression of the plungers 47.

The actuating body 12 of the switch 10 is disposed upon the base 14 such that it can be maneuvered so as to simultaneously or non-simultaneously engage pin plungers 47 and the eyelets 40 and 42. In the illustrated exemplary embodiment, the actuating body 12 bears upon the pivot rod 44 which creates a fulcrum upon which the actuating body 12 may be pivoted about an axis X-X of the pivot rod 44. See FIG. 6. Pivoting the actuating body 12 in one direction results in an interior of the body 12 striking the corresponding lever actuator 46 which then in turn depresses the respective pin plunger 47 into the raised housing 36 where it triggers the above-discussed electronics and controls. Pivoting the actuating body 12 in the opposite direction releases the first pin plunger 47, which is returned to its projected state by a spring, and results in the interior of the body 12 striking the opposite lever actuator 46 thus depressing the corresponding pin plunger 47 into the raised housing 36 and hence triggering the respective electronics and controls. When not engaged by the body 12, the pin plungers 47 return to their projected state by an internal spring arrangement. When pressure is not applied to the actuating body 12, it resides in a neutral, non-pivoted state due to the closed end eyelets 40, 42. That is, the eyelets 40, 42 exert an upward spring force to maintain the body 12 in a general horizontal orientation in which neither of the eyelets 40, 42 are depressed. To pivot the body 12 and engage the lever actuators 46 and pin plungers 47 as described, the spring force exerted by the eyelets 40, 42 must be overcome by a downward force. When this downward force is removed, the eyelets 40, 42 return the body 12 the neutral position. In an alternate embodiment, one the eyelets 40, 42 is held fixed and prevented from retracting into the raised portion 36 of the base 14. In this embodiment, the actuating body 12 is capable of pivoting only in the direction of the opposite eyelet 40, 42. For example, if eyelet 40 is fixed, a user may rest their foot against the fixed end of the body 12 and use their foot to pivot the body 12 in the direction of eyelet 42. In this scenario, only the pin plunger 47 proximate to the eyelet 42 could be depressed. Alternatively, the lever actuators 46 can be adjusted such that both pin plungers 47 can be depressed; the plunger 47 proximate to eyelet 40 would be depressed at the beginning of the stroke and the opposite pin plunger 47 would be depressed toward the end of the stroke. In general, the lever actuators 46 provide more stroke and less sensitivity during the operation and furthermore, aid in adjusting the operating point of the switch or control. In a further embodiment, a cavity within the raised portion 36 of the base 14 of the switch 10 may be filed partially or entirely with a potting compound.

As mentioned, the switch 10 is configured to be disposed in communication with desired equipment. Such equipment may include medical or dental instruments, industrial mechanism, etc. The switch 10 can be connected to such equipment by physical cables and/or wirelessly by BLUE-TOOTH, BLUE-TOOTH LIGHT, infrared, ZIGBY, ANT, etc.

The switch 10 is intended to be operated by the foot of a user. The arcuate shape of the switch 10 creates an area 50 for receiving the foot. See FIG. 5. The heel of the foot can be placed at a distal end 52 of the area 50, and the ball of the foot or the toes can be placed upon the upper surface 32 of the actuating body 12. When the switch 10 is not in use, the toes of the foot can be placed comfortably in the recess 53 formed by the arc edges 16 and 24. The curvature formed at the recess 53 by the arcs 16 and 24 mimic the shape of the front of a shoed foot and thus visually encourages the user to dispose the foot in this position during periods of rest when the switch 10 is not utilized. Also, the curvature of the recess 53 and the overall curvature of the switch 10 represents to the user the proper orientation of the switch 10 during use. That is, the unique curvature of the switch 10 communicates to and encourages the user to approach the switch 10 with their foot disposed in the area 50 rather than approaching the switch form the opposite side. The convex side of the switch 10 visually and ergonomically discourages the user from placing their foot upon the outer arc edge 18 and from attempting to activate the switch 10 from this orientation. To the contrary, the concave side of the switch formed by the arc edges 16 and 24 visually and ergonomically encourage the user to place their foot in the area 50 for operating the switch. This advantage of the unique shape of the switch 10 prevents misalignment of the foot relative to the switch and thus avoids misuse thereof. The inclination of the upper surface 32 of the actuating body 10 and the curved profile 34 of the edges 16, 18, 20, and 22 of the body 10 also serve to visually and ergonomically communicate to the user the proper orientation of their foot relative to the switch 10. That is, the user is dissuaded from approaching the switch 10 from the convex outer side due to the presence of the convex arc edges 18, 26 and the upper surface 32 which, from this convex outer side, would decline away from the user. On the other hand, the inner concave side, having the concave arc edges 16, 24, and the upwardly sloping surface 32 delimit a receptive space for the user's foot.

As mentioned, the above discussed features of the switch 10 communicate visually and ergonomically to the user regarding proper use of the switch 10 and proper placement of the foot relative thereto. This occurs visually due to the receptive visual appearance of the inner concave side of the switch 10. This occurs ergonomically due to the haptic and tactile response provided to the user's foot by the unique construction and shape of the switch 10. For example, when the user's foot is placed properly upon the switch 10, as described above with reference to FIG. 5, the user feels nearly the entire width of the switch on the bottom of their foot. The first metatarsal bone is positioned above or at least proximate to the first closed end eyelet 40 and the fifth metatarsal bone is proximate to the second closed end eyelet 42, and the center of the ball of the foot is located generally above the pivot assembly 38. This gives the user a feeling of comfort upon the switch 10 in that the forefoot is fully supported. Also, the inclination of the upper surface 32 of the actuating body 12 mimics the natural upward inclination of a foot placed with heel upon the floor so that the remainder of the foot is angled upward to meet the switch 10. This adds to the receptive and comfortable feeling provided to the user. The user also experiences a feel of control as a simple rocking of the foot pivots the body 12 and activates the switch (discussed more in detail below). Conversely, if the user places their foot upon the switch with their heel on the outer convex side of the switch 10, a small portion of the second through third metatarsals would contact the switch above the pivot assembly 38. The outer portions of the forefoot would not even engage the switch 10 and pivoting the actuating body 12 would be difficult. Moreover, the upper surface 32 of the body 12 would descend awkwardly from the point of contact of the foot upon the switch 10. These features would provide an uncomfortable and ineffective feeling to user. Thus, the user would know immediately, through haptic and tactile feedback, that the orientation of their upon the switch 10 was incorrect.

Actuation of the switch 10 with the foot placed properly thereon is nearly effortless and is the result of a minimal and natural feeling movement of the foot. With the heel disposed in the area 52 illustrated in FIG. 5 and the forefoot disposed upon the upper surface 32, the actuating body 12 is pivoted about the pivot assembly 38 by a simple pivot of the foot. For example, if the right foot is placed upon the switch 10, a slight pivot of the foot toward the 'big' toe tilts the actuating body 12 in the same direction thus engaging and depressing the first closed end eyelet 40. Pivoting the right foot toward the 'pinky' toe similarly engages the second closed end eyelet 42. That is, the foot is not required to break contact with the switch 10 in order actuate both of the plungers 40 and 42. The foot can merely be pivoted about the point of contact of the heel upon the floor. This allows for rapid operation of the switch 10, reduces fatigue of the user associated with lifting the foot, and reduces the occurrence of mis-strikes or mis-alignments associated with removing the foot from a switch during successive toggles.

Alternatively of course, if desired, a user may lift up their forefoot while keeping their heel upon the ground, or the entire foot may be lifted up, and either ends of the switch 10 contacted in a striking fashion in order to actuate the plungers 40, 42.

The actuating body 12 of the switch 10 is described herein as being configured to toggle underlying plunger switches through a pivoting movement. This, of course, is merely exemplary. The switch 10 can be configured to be actuated in any desired manner. For example, the actuating body 12 can be configured to move in a vertical axis to engage a single plunger element disposed thereunder which can operate in a single stage or multiple stage depression arrangement. Alternatively, the body 12 can maintain its unique arcuate shape but include two or more distinct portions which are separately moveable to contact and engage two or more respective underlying plunger elements, etc.

The above-mentioned electronics and controls of the switch 10 can be configured to operate associated equipment in any desired manner. For example, successive actuations of the body 12 can send identical or different operational signals to one or more associate pieces of equipment, the switch 10 can be used to power, operate, and/or activate such equipment, etc.

As described thus far, the switch 10 is configured to be placed on the floor and actuated by the foot of a user. This is of course merely exemplary. In another embodiment of the invention, the switch 10 is disposed in an elevated position relative to the floor. For example, the switch 10 is affixed to a stool or a chair upon which a user, such as a medical doctor or technician, sits. In this way, the doctor or technician can operate the switch from a seated position. Similarly, the switch 10 can be mounted on a platform which is positioned adjacent to a stool or chair such that the seated user can place their foot upon the platform and easily and comfortably operate the switch 10 in the manner described hereinabove.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another.

What is claimed is:

1. A switch comprising:

an actuating body; and a base;

wherein the actuating body is movably disposed upon the base;

wherein the actuating body has an arcuate shape delimited by generally parallel arc edges joined at their ends by curved edges;

wherein the actuating body includes an upper surface which inclines in a direction from a concave side of the arcuate shaped actuating body to a convex side thereof; and wherein the actuating body is configured to pivot in a direction toward at least one of the end curved edges;

wherein the arcuate shape of the actuating body delimits a generally triangular area for receiving the foot of a user, the generally triangular area extending horizontally from the concave side, the concave forming base of the generally triangular area, and an apex of the generally triangular area being disposed opposite of concave side.

2. The switch according to claim 1, wherein the generally triangular area and the arcuate shaped actuating body define a visual cue which directs the user to place a foot within the generally triangular area with a heel proximate to the apex.

3. The switch according to claim 1, wherein the concave side of the arcuate shaped actuating body and the inclined surface form visual and ergonomic cues which direct the user to place a metatarsal portion of a foot on the upper surface with a heel of the foot disposed in the generally triangular area on the concave side of the arcuate shaped actuating body.

4. The switch according to claim 3, wherein the upper surface proximate to the concave side of the arcuate shaped actuating body is relatively higher than the upper surface proximate to the concave side; and wherein the convex side and the higher portion of the upper surface form visual and ergonomic cues which direct the user against placing the foot on the convex side of the arcuate shaped actuating body.

5. A switch comprising:

an actuating body; and a base;

wherein the actuating body is movably disposed upon the base;

wherein the actuating body has an arcuate shape delimited by generally parallel arc edges joined at their ends by curved edges;

wherein the actuating body includes an upper surface which inclines in a direction from a concave side of the arcuate shaped actuating body to a convex side thereof; and wherein the actuating body is configured to pivot in a direction toward at least one of the end curved edges wherein:

the upper surface includes a first portion and a second portion;

the first portion extending from the concave side of the arcuate shaped body to a transition area the second portion extending from the transition area to the convex side of the arcuate shaped actuating body;

wherein the first portion is inclined in a direction from the concave side toward the transition area; and wherein the second portion is generally horizontal.

6. The switch according to claim 5, wherein the transition area comprises a curved line which traverses the upper surface in concave manner with respect to the convex side of the arcuate shaped actuating body such that the curved line forms an elliptical shape with the convex side.

7. The switch according to claim 5, further comprising:

a cavity delimited within the base, and a potting compound disposed within the cavity.

8. The switch according to claim 5, wherein the base comprises the arcuate shape of the actuating body.

9. The switch according to claim 5, wherein base comprises a shape complimentarily to the arcuate shape of the actuating body, and wherein the base comprises an outer perimeter which is larger than an outer perimeter of the actuating body.

10. The switch according to claim 5, further comprising:

a centrally disposed pivot about which the actuating body is configured to pivot in said direction toward at least one of the end curved edges;

a first switching element disposed on a first side of the pivot;

wherein the first switching element is contacted by the actuating body when the body pivots toward a first of said curved edges.

11. The switch according to claim 10, further comprising:

a second switching element disposed on a second opposite side of the pivot;

wherein the second switching element is contacted by the actuating body when the body pivots toward a second of said curved edges.

12. The switch according to claim 11, further configured to detect the contact of the first and/or second switching element and initiate an action in response thereto.

13. The switch according to claim 11, further comprising:

a first spring element disposed proximate to the first switching element wherein the first spring element is configured to exert a force opposite to the movement of the actuating body toward the first curved edge; and a second spring element disposed proximate to the second switching element wherein the second spring element is configured to exert a force opposite to the movement of the actuating body toward the second curved edge.

14. The switch according to claim 13, wherein at least one of the first and second spring elements is fixed to prevent said movement toward the respective first and/or second curved edge.

* * * * *